United States Patent [19]

Olsen et al.

[11] 4,069,749

[45] Jan. 24, 1978

[54] EXPANSIBLE DRIVE SHAFT TOOL MECHANISM

[75] Inventors: John H. Olsen, Vashon; Albert C. Saurwein, Seattle, both of Wash.

[73] Assignee: Flow Research, Inc., Kent, Wash.

[21] Appl. No.: 712,200

[22] Filed: Aug. 6, 1976

[51] Int. Cl.[2] ..... B26D 1/12

[52] U.S. Cl. ..... 93/58.1; 83/498; 83/665; 93/58.2 R

[58] Field of Search ..... 83/665, 498, 499, 504; 93/58 R, 58.1, 58.2 R

[56] References Cited

U.S. PATENT DOCUMENTS

| | | | |
|---|---|---|---|
| 2,971,765 | 2/1961 | Atherholt, Sr. | 279/4 |
| 3,173,325 | 3/1965 | Warren et al. | 83/499 |
| 3,742,714 | 7/1973 | Thomas | 83/498 X |
| 3,782,234 | 1/1974 | Rodach | 83/665 |
| 3,917,422 | 11/1975 | Betzler | 83/665 X |

FOREIGN PATENT DOCUMENTS

| | | | |
|---|---|---|---|
| 30,487 | 7/1959 | Finland | 83/665 |
| 2,126,018 | 12/1972 | Germany | 83/665 |

*Primary Examiner*—James F. Coan
*Attorney, Agent, or Firm*—Christensen, O'Connor, Garrison & Havelka

[57] ABSTRACT

An expansible drive shaft tool mechanism is disclosed in which mutually cooperating parallel drive shafts carry tool elements that can be shifted into and locked by shaft expansion in any of selected positions along such drive shafts. Applied hydraulic pressure in a sealed chamber causes outward expansion of a flexible outer sleeve member on each such shaft to grip the tool elements. An inner sleeve member closely encircled by the outer sleeve member and joined in sealed relationship therewith at opposite end portions forms the radially thin elongated annular sealed chamber into which the pressurized hydraulic fluid is forced by the action of a plunger type hydraulic pressure source housed inside the inner sleeve member cavity. Actuation of the hydraulic pressure source plunger passing through a cylindrical fluid take-up chamber by longitudinal displacement is effected by means of a pneumatic piston energizable through a connecting line including a low pressure rotary seal or union. Hydraulic fluid that may leak past a primary seal along the plunger is taken up in the seal chamber which, of cylindrical form, incorporates a sliding piston or seal element contacting the plunger and cavity wall and urged by a return spring to exert pressure on such accumulating hydraulic fluid tending to return it to the hydraulic cylinder. Such seal chamber including the spring-returned seal element is thus available to take up leakage of hydraulic fluid seeping past the primary seal, whether caused by operating pressure or by thermal expansion of fluid in the system, and to urge the fluid back through a check valve when the pressure drops again.

10 Claims, 1 Drawing Figure

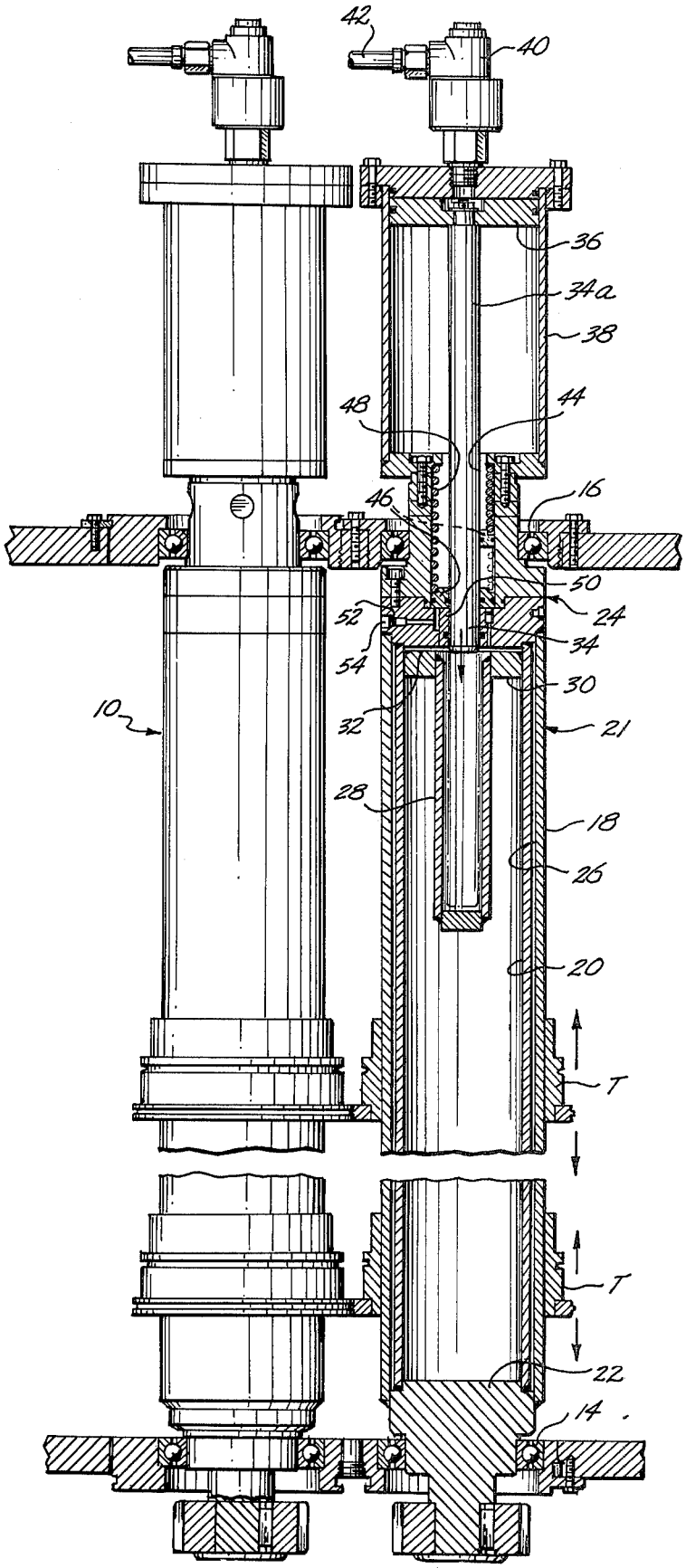
42
40
36
34a
38
48
44
46
16
50
52
24
54
34
30
10
32
21
28
18
26
20
T
T
22
14

EXPANSIBLE DRIVE SHAFT TOOL MECHANISM

BACKGROUND OF INVENTION

This invention relates to an improved expansible drive shaft rotary tool system and more particularly to hydraulically actuated expansible multiple drive shafts and associated variably positioned tools mounted on the drive shafts. The invention is herein illustratively described by reference to the presently preferred embodiment thereof; however, it will be recognized that certain modifications and changes therein with respect to details may be made without departing from the essential features involved.

The drive shaft mechanism comprising the present invention is applicable for example to supporting and rotatively driving sets of rotary male and female creasing wheels used in forming the fold lines for corrugated board box panels and the like. Precise positioning and continued mutual registry of the cooperating sets of creasing wheels is therefore desirable together with the ability to quickly and easily change their positions for different job requirements. Numerous other tool positioning applications also exist in industry wherein the invention may be applied to advantage such as cutters, grinders and many others.

It is not new in the art to employ expansible drive shafts to maintain rotary tools in any of selected operating positions along a shaft. For example, Warren et al. U.S. Pat. No. 3,173,325 discloses one such proposal wherein the support shafts for the tools are hollow to accommodate hydraulic fluid variably pressurizable to control the degree of expansion of the shaft wall and thereby the holding force exerted on the surrounding tools. Floating bearings are necessary in that case due to endwise expansion of the shaft accompanying its lateral bulging or expansion to hold the tools.

Wyllie et al. U.S. Pat. No. 3,166,013 represents another patent disclosing an expansible shaft in this case for supporting a tubular printing cylinder or for varying the tension or driving force on a web of paper. In that example grooves or channels in the base cylinder surface closely surrounded by the expansion sleeve communicate fluid to the various areas within the sleeve to effect its expansion with the printing tube centered on the shaft in order to hold the printing tube in place when fluid pressure is increased within the grooves.

In addition hydraulically expansible mandrels pressurized by internal piston-cylinder units have been proposed heretofore as mounting supports for individual tools, examples being U.S. Pat. Nos. to Atherholt, Sr., 2,971,765; Better et al., 2,963,298; and Sturgis, 2,938,347.

An object of the present invention is to provide a quick-acting, compact, lightweight, and leak-proof hydraulically actuatable expansible shaft mechanism that can be made as long as desired and of any desired diameter, while requiring minimum volumetric space in its expansion chamber, pressure source cylinder and connecting passages.

Another and related objective is to provide such a mechanism substantially devoid of tool position shifting caused by shaft elongation when the shaft's pressure chamber is pressurized, yet which does not sacrifice expansion sleeve flexibility in achieving this result. Thus, support bearings for the shaft may be conventional (i.e., need not be of the "floating" type) to accommodate endwise shifts, and precise positioning of tool elements along the shaft, whether established manually or by automatic positioning mechanisms, will be maintained during shaft expansion to grip and lock such tool elements in place.

In addition it is an object of the invention to incorporate compact and effective hydraulic fluid take-up and make-up provisions in such a shaft mechanism that not only reduces the chance of exterior leakage of hydraulic fluid under the high internal pressures used (e.g., up to 3,000 psi, for example) but that also serves as a source of make-up fluid to replace fluid seeping past the primary seal associated with the hydraulic plunger pressurization device should any such exterior leakage occur. In addition such make-up device provides a means to accommodate changes in total hydraulic fluid volumetric containment requirements caused by substantial temperature variations expanding or contracting the incompressible hydraulic fluid.

A more specific object hereof is to devise such a shaft mechanism wherein maximum effective shaft diameter expansion may be achieved by pressurization within the expansion chamber of the shaft without causing attendant and commensurate lengthening of the shaft and without incurring problems of shaft eccentricity affecting axial alignment of the rotary tool elements mounted on the shaft.

Still another object is a shaft mechanism of the described type employing a combined pneumatic and hydraulic pressurization apparatus avoiding the usual problems with rotary high pressure seals that must contain the fluid against leakage at high rotational shaft speeds such as 500 rpm or more. With the improved mechanism all of the hydraulic system is contained with the rotary shaft.

BRIEF DESCRIPTION OF INVENTION

As herein disclosed the invention employs an expansible elongated shaft that is mounted on longitudinally spaced bearings between which the one or more rotary tool elements slidably surrounding and mounted on the shaft may be adjustably positioned. The shaft comprises an elongated flexible (i.e., thin walled) and resiliently expansible cylindrical outer sleeve member and an associated cylindrical sleeve member closely surrounded by the outer sleeve member and forming a fluid-tight rigid joint therewith at longitudinally spaced points. An elongated, radially thin, annular, fluid-filled sealed chamber is thereby formed between the two sleeve members and is connected to a variable pressure hydraulic source selectively operable to vary the pressure of fluid within such chamber and thereby the holding force exerted on the surrounding tool elements effected by outer sleeve expansion. Because of the configuration of the sleeve members forming the radially thin sealed chamber and the mechanical interconnection of these sleeve members at the ends of such chamber, any longitudinal expansion force exerted by hydraulic piston effect endwise on the outer sleeve member tending to displace the tools from their assigned positions has rather minimal effect. Likewise avoided is the problem of bearing stresses caused by shaft lengthening under the hydraulic pressure used to effect shaft diameter expansion.

The low volumetric fluid capacity requirement of the sealed chamber permits use of a relatively small and compact hydraulic source unit to vary the pressure within that chamber and permits convenient housing of such a pressure source, cantilevered endwise into the hollow interior of the inner sleeve member of the shaft.

A pressurizing plunger passing through a cylindrical seal cavity is connected externally to a pneumatic piston. The area of the pneumatic piston is significantly greater than the area of the pressurizing plunger. The pneumatic piston of large diameter can thus be supplied with operating pressure of relatively low magnitude in the connecting hose.

A sliding seal element in sealing contact with the plunger and surrounding wall of the cylindrical seal chamber is backed by a return spring and thereby yieldably accommodates varying amounts of hydraulic fluid seeping into the seal cylinder, and tends to return that fluid back to the hydraulic pressure cylinder and associated passages leading into the shaft chamber through a check valve when pressure is reduced therein.

Moreover because of the very low volume of hydraulic fluid required to fill the sealed chamber, the shortness of the passages leading to that chamber from the hydraulic plunger cylinder pressure source due to the location of the latter within the adjacent ends of the expansion shaft, it is possible to release and lock the tool elements on the expansible shaft with very little time lag and with a small energy requirement.

These and other features, objects and advantages of the invention will become evident to a person skilled in this art based on the following description of the illustrative embodiment.

DESCRIPTION OF DRAWING

The accompanying drawing FIGURE is a side view of the illustrative mechanism for creasing corrugated board panels as mentioned above, illustrating two sets of creasing rolls operatively mounted and adjustably positionable on parallel drive shafts of the expansible type incorporating features of this invention, one of said shafts and associated apparatus carried by it being shown in longitudinal section.

DETAILED DESCRIPTION OF PREFERRED EMBODIMENT

With reference to the drawing, shafts 10 and 12 are or may be substantially identical in construction as are the hydraulic pressure sources therein and the means for actuating the same. Consequently, only the details of shaft 12 are depicted in the illustration by sectioning and detailing of parts therein, and only these will be described in detail hereinafter.

Elongated shaft 12 is rotatively supported at its ends by bearings 14 and 16 which may be a conventional type of ball bearing or roller bearing. Between the bearings the shaft comprises an elongated resiliently expansible cylindrical outer thin-wall sleeve member 18 and a cylindrical inner hollow sleeve member 20 closely encircled or surrounded by the outer sleeve member. These coaxially extending sleeve members are suitably joined at their ends, as by welding them together or to shaft end "plugs" or heads 22 and 24 to form a fluid-tight joint between the sleeve members. Due to the close spacing between the sleeve members in a radial sense they thereby define a radially thin elongated annular (fluid filled) sealed chamber 26 that extends the full coextending length of the sleeve members. This chamber is radially thin preferably of the order of a few percent in radial "thickness" of its average diameter. At one end, the chamber is placed in communication with a hydraulic pressure cylinder 28. Cylinder 28 is mounted on a web or disk 30 joined to or part of the shaft plug 24 and projecting cantilevered into the hollow interior of the inner sleeve member 20 as shown. Radial flow passages 32 place the sealed chamber 26 in fluid communication with the interior of the hydraulic pressure cylinder 28. A hydraulic plunger 34 coaxial with the cylinder 28 extends from the cylinder 28 past a primary fluid seal 50. The plunger rod 34 can thus be inserted to varying degrees into the interior of the cylinder 28 so as to displace hydraulic fluid therein and thereby produce variable increase of hydraulic pressure communicated to the sealed chamber 26.

Plunger 34 extends axially from the cylinder 28 to connect with pneumatic piston 36 of substantially larger diameter than plunger 34. Piston 36 is received in pneumatic cylinder 38 also mounted on the shaft 12 and rotatable therewith. A rotary pneumatic seal or union 40 is connected to the pneumatic cylinder 38 so as to deliver air under pressure to the latter from a hose 42 leading to a stationary external pneumatic pressure source (not shown). Thus by selective pressurization of the relatively large-diameter air cylinder 38 varying pressure changes may be developed in the hydraulic cylinder 28 of much higher magnitudes for application to the sealed chamber 26, thereby to expand the outer sleeve 18 into contact under varying pressures with the tool elements T thereon.

In passing from the hydraulic cylinder 28 to the air cylinder 38 the plunger 34 passes through a seal chamber 44 coaxial with the plunger and containing a sliding seal element 46 that makes sealing contact with both the plunger and the inner wall of the cylinder. A helical spring 48 interposed between the sealing element 46 and one end wall of the sealing chamber 44 urges the sealing element in the direction toward the hydraulic cylinder 28. A check valve 53 connects this small spring pressurized chamber 55 with the main sealed chamber 26. Thus should there be any leakage of hydraulic fluid from the hydraulic cylinder past the plunger and the primary seal 50 associated with the plunger at the entrance to the hydraulic cylinder that leakage will be taken up in the variable space provided in the seal chamber 55 by yieldable positioning of the sealing element 46 therein. Upon release of pneumatic pressure in cylinder 38 and return of plunger 34, the oil leaked under pressure from chamber 26 is returned to chamber 26 through check valve 53.

In the illustration a check valve 52 is mounted in a radial passage 54 leading into the chamber 55 to permit supply of hydraulic fluid to the latter and thereby through valve 53 to the sealed chamber 26. Normally this valve 52 is closed, however, and the system including the various chambers and passages within the expansible shaft and its associated pressurization means represents a self-contained system. Leakage is to be avoided and pressure changes accompanying expansion and contraction of the hydraulic fluid due to temperature effects should also be accommodated and avoided so as to not interfere with ease of positioning of the tool elements T along the shaft when the actuating pressure therewithin is removed. A pressure of about 30 lbs./sq. in., more or less, is exerted by the spring 48 on the sliding seal element 46. By illustrator's license in the drawing, the element 46 is shown in full body in position adjacent the cylinder 28 with the spring 48 extended, and is shown in half in a retracted position with the spring 48 fully compressed.

In operation the hydraulic passages and chambers within the shaft system are initially filled through the plugs 56 and are preferably filled to the point that all the air is bled out of the expansion chamber 26 and connecting passages. The chamber 55 is then filled through valve 52 until the spring on floating piston 46 is compressed.

With the fluid system at minimum pressure (i.e. the plunger 34 retracted), the tool element T may be shifted to the desired operating positions along the shaft quite readily, this being done either manually or by mechanical devices. For instance a computer controlled stepping motor device may be used to selectively position the elements T along the shafts 10 and 12 suiting the requirements of a particularl job to be done. Thereupon pneumatic pressure delivered through conduit 42 and rotary seal 40 into the lefthand end of pneumatic cylinder 38 causes the piston 36 to move to the right which thereby forces the hydraulic plunger 34 into the cylinder 28 to increase the hydraulic pressure within the expansion chamber 26. Such increase of pressure causes the flexible outer sleeve 18 to flex or bulge outwardly into simultaneous forcible engagement with the tool elements T to lock the tool elements in position. Because of the flexibility of the sleeve 26, all of the tool elements are effectively locked regardless of their proximity to the shaft end plugs 22 and 24.

When it is desired to reposition the tool elements T, air pressure exerted on the piston 36 is removed permitting resilient recoil of the stressed sleeves 18 and 20 to expel pressurized fluid from the chamber 26. Pressure in the chamber drops and the tool elements can then be readily shifted to new positions.

Having thus described the preferred embodiment of the invention, it will be appreciated that various changes and modifications of detail may be made without departing from the essentials involved. These essentials, including the novel combinations comprising the invention, are set forth in the claims that follow:

What is claimed is:

1. The combination comprising an elongated shaft, bearing means rotatably supporting said shaft at longitudinally spaced points thereon, at least one tool element slidably surrounding and movable to different operating positions on said shaft between said bearing means, said shaft comprising, between said bearing means, an elongated resiliently expansible cylindrical outer sleeve member and a cylindrical inner member closely surrounded by and extending longitudinally and coaxially within said outer sleeve member, means forming sealed connections between said members at longitudinally spaced points to define an annular elongated pressurizable chamber therebetween of a thickness radially of said shaft constituting a minor fraction of the average diameter of said chamber, a variable hydraulic fluid pressure source, connecting means placing said source in communication with said chamber, said source being operable to selectively increase pressure in said sealed chamber and thereby expand the diameter of said sleeve member into forcible holding engagement with said tool element.

2. The combination defined in claim 1, wherein the hydraulic fluid pressure source comprises a hydraulic cylinder fixed coaxially on said shaft, a plunger member longitudinally movable within said hydraulic cylinder, a pneumatic piston operatively connected to said plunger, and means to selectively operate said pneumatic piston so as to move the hydraulic plunger member and thereby vary the hydraulic pressure in the chamber, said connecting means placing said hydraulic cylinder in communication with said chamber.

3. The combination defined in claim 2, wherein the shaft includes an elongated cylindrical seal cavity, said plunger extending axially through said seal cavity, a longitudinally slidable seal element surrounding said plunger in said seal cavity in fluid sealing contact with both, and second connecting means placing said seal cavity in communication with said hydraulic cylinder, said second connecting means including means for allowing fluid flow only from said seal cavity to said hydraulic cylinder, and yieldable force-producing means urging said seal element lengthwise in said seal cavity in a direction tending to force hydraulic fluid leaking into said seal cavity from said hydraulic cylinder through said second connecting means.

4. The combination defined in claim 1 wherein the pressure source comprises a hydraulic cylinder fixed coaxially with and accommodated at least partially within said cylindrical inner member, a plunger projecting axially from said shaft and mounted thereon to be longitudinally movable within said hydraulic cylinder, and plunger actuating means including relatively rotatable elements one of which is fixed on the plunger operable to shift the plunger longitudinally so as to vary the pressure of hydraulic fluid communicated from said hydraulic cylinder to said chamber.

5. The combination defined in claim 3 wherein the pressure source comprises a hydraulic cylinder fixed coaxially with and accommodated at least partially within said cylindrical inner member, a plunger projecting axially from said shaft and mounted thereon to be longitudinally movable within said hydraulic cylinder, and plunger actuating means including relatively rotatable element one of which is fixed on the plunger operable to shift the plunger longitudinally so as to vary the pressure of hydraulic fluid communicated from said hydraulic cylinder to said chamber.

6. The combination comprising an elongated shaft, bearing means rotatably supporting said shaft at longitudinally spaced points thereon, at least one tool element slideably surrounding and movable to different operating positions on said shaft between said bearing means, said shaft comprising, between said bearing means, an elongated resiliently expansible cylindrical outer sleeve member and a cylindrical inner hollow sleeve member closely surrounded by and extending longtudinally and coaxially within said outer sleeve member, means forming sealed connections between said members at longitudinally spaced points to define an annular elongated pressurizable chamber therebetween of a thickness radially of said shaft constituting a minor fraction of the average diameter of said chamber, a variable hydraulic fluid pressure source, connecting means placing said source in communication with said chamber, said source being operable to selectively increase pressure in said chamber and thereby expand the diameter of said sleeve member into forceable holding engagement with said tool element.

7. The combination defined in claim 6, wherein the hydraulic fluid pressure source comprises a hydraulic cylinder fixed coaxially within the hollow of said hollow sleeve member, a plunger member within said hydraulic cylinder, a pneumatic piston mounted on one end of said shaft and operatively connected to said plunger member, and means to selectively operate said pneumatic piston so as to move the hydraulic piston member and thereby vary the hydraulic pressure in the fluid-filled expansion chamber.

8. The combination defined in claim 7, wherein the shaft includes an elongated cylindrical seal cavity and the plunger member extends axially through said seal cavity, a longitudinally slidable seal element surrounding said plunger member in said seal cavity in fluid sealing contact with both, and second connecting means placing said seal cavity in communication with said hydraulic cylinder, said second connecting means including means for allowing fluid flow only from said seal cavity to said hydraulic cylinder, and yieldable force-producing means urging said seal element lengthwise in said seal cavity in a direction tending to return hydraulic fluid leaking into said seal cavity from said hydraulic cylinder through said second connecting means.

9. The combination defined in claim 6 wherein the pressure source comprises a hydraulic cylinder fixed coaxially with and accommodated at least partially within said cylindrical inner member, a plunger projecting axially from said shaft and mounted thereon to be longitudinally movable within said hydraulic cylinder, and plunger actuating means including relatively rotatable elements on of which is fixed on the plunger operable to shift the plunger longitudinally so as to vary the pressure of hydraulic fluid communicated from said hyraulic cylinder to said chamber.

10. The combination comprising two elongated shafts, bearing means positioning said shafts in parallel adjacent relationship and rotatably supporting each of said shafts at longitudinally spaced points thereon, a plurality of tool elements slideably surrounding and movable to different operating positions on each of said shafts between said bearing means to cooperate with a tool element on the other such shaft, each of said shafts comprising, between said bearing means, an elongated resiliently expansible cylindrical outer sleeve member and a cylindrical inner member closely surrounded by and extending longitudinally and coaxially within said outer sleeve member, means forming sealed connections between said members at longitudinally spaced points to define an elongated pressurizable chamber therebetween of a thickness radially of said shaft constituting a minor fraction of the average diameter of said chamber, a variable hydraulic fluid pressure source, connecting means placing said source in communication with said chamber, said source being operable to selectively increase pressure in said chamber and thereby expand the diameter of said sleeve member into forceable holding engagement simultaneously with said tool elements.

* * * * *